US005752134A

United States Patent [19]

Hazama et al.

[11] Patent Number: 5,752,134

[45] Date of Patent: May 12, 1998

[54] PROCESS UNIT OF IMAGE FORMING MACHINE HAVING PRE-TRANSFER GUIDE

[75] Inventors: Hiroyuki Hazama; Masaru Watanabe; Yukinori Akiyama; Masanobu Maeshima; Hirotsugu Ogawa; Takahiko Murata, all of Osaka, Japan

[73] Assignee: Mita Industrial Co., Ltd., Osaka, Japan

[21] Appl. No.: 853,903

[22] Filed: May 9, 1997

[30] Foreign Application Priority Data

May 31, 1996 [JP] Japan ..... 8-137308

[51] Int. Cl.[6] ..... G03G 21/18

[52] U.S. Cl. ..... 399/113; 399/316; 399/388

[58] Field of Search ..... 399/111, 316, 399/317, 388, 113, 121, 124

[56] References Cited

U.S. PATENT DOCUMENTS

| | | | |
|---|---|---|---|
| 4,101,212 | 7/1978 | Sumiyoshi et al. | 399/316 |
| 4,464,042 | 8/1984 | Omori et al. | 399/316 |
| 4,547,059 | 10/1985 | Nagayama et al. | 399/165 |
| 4,609,276 | 9/1986 | Mitzutani | 399/111 |
| 4,809,033 | 2/1989 | Ikemoto et al. | 399/111 |
| 4,873,548 | 10/1989 | Kobayashi et al. | 399/111 |
| 4,882,606 | 11/1989 | Deguchi | 399/316 |
| 5,055,876 | 10/1991 | Matsuoka et al. | 399/111 |
| 5,095,334 | 3/1992 | Nukaya | 399/111 |
| 5,594,539 | 1/1997 | Murano et al. | 399/316 |

*Primary Examiner*—Robert Beatty

*Attorney, Agent, or Firm*—Beveridge, DeGrandi, Weilacher & Young, LLP

[57] ABSTRACT

A process unit of an image forming machine, comprising a photoconductor unit including a photoconductor drum, and a developing unit for developing a latent electrostatic image formed on the photosensitive layer of the photoconductor drum to a toner image, the photoconductor unit and the developing unit being connected by a support shaft so as to be pivotable relative to each other; in which a pre-transfer guide plate for guiding a transfer sheet to be conveyed to a transfer zone is disposed on a photoconductor support means for supporting the photoconductor drum rotatably, and the rear surface of the pre-transfer guide plate is brought into contact with the support shaft or a development housing.

5 Claims, 4 Drawing Sheets

PROCESS UNIT OF IMAGE FORMING MACHINE HAVING PRE-TRANSFER GUIDE

FIELD OF THE INVENTION

The present invention relates to a process unit for forming a toner image on a photosensitive layer of a photoconductor drum in an image forming machine such as an electrostatic copier or a laser printer.

DESCRIPTION OF THE PRIOR ART

In recent years, wide use has been made of an image forming machine in which a photoconductor drum having a photosensitive layer, and a developing device for developing a latent electrostatic image formed on the photosensitive layer of the photoconductor drum are mounted on a frame to serve integrally as a process unit, and this process unit is mounted detachably in a machine housing.

To a transfer zone of the photoconductor drum in the process unit, a sheet of transfer paper (transfer sheet) for bearing a toner image, formed on the photoconductor drum, upon transfer needs to be conveyed.

In the machine housing where the process unit is mounted, a guide plate for guiding the transfer sheet to the transfer zone is disposed. This guide plate should be always kept in a highly accurate positional relationship with the photoconductor drum in order to guide the transfer sheet to a proper position in the transfer zone. When a transfer sheet with a large thickness and a high stiffness, such as a postcard, is used, the front end of the transfer sheet is guided by the guide plate and contacted with the photoconductor drum. Then, its front end portion is bent, and this bend presses the guide plate strongly. Its pressing force deflects the guide plate, causing a deviation in its positional relationship with the photoconductor drum, thus posing the problem that the guide plate cannot guide a transfer sheet to the proper position in the transfer zone.

SUMMARY OF THE INVENTION

A principal object of the present invention is to provide a process unit of an image forming machine, which the process unit can prevent the deflection of a guide plate for guiding a transfer sheet to a transfer zone even when a pressing force of the transfer sheet acts on the guide plate, thus keeping the positional relationship between the guide plate and the photoconductor drum always highly precise.

To attain this principal object, the present invention provides a process unit of an image forming machine, the process unit comprising a photoconductor unit including a photoconductor drum having a photosensitive layer, and a developing unit for developing a latent electrostatic image formed on the photosensitive layer of the photoconductor drum to a toner image, the photoconductor unit and the developing unit being connected by a support shaft so as to be pivotable relative to each other, and the process unit being adapted to transfer the toner image to a transfer sheet conveyed to a transfer zone of the photoconductor drum; wherein the photoconductor unit includes a photoconductor support means for supporting the photoconductor drum rotatably, a pre-transfer guide plate for guiding a transfer sheet to be conveyed to the transfer zone is disposed on the photoconductor support means, and when a pressing force by a transfer sheet is exerted at least during the guidance of the transfer sheet, the rear surface of the pre-transfer guide plate is brought into contact with the support shaft.

The present invention also provides a process unit of an image forming machine, the process unit comprising a photoconductor unit including a photoconductor drum having a photosensitive layer, and a developing unit for developing a latent electrostatic image formed on the photosensitive layer of the photoconductor drum to a toner image, and the process unit being adapted to transfer the toner image to a transfer sheet conveyed to a transfer zone of the photoconductor drum; wherein the photoconductor unit includes a photoconductor support means for supporting the photoconductor drum rotatably, a pre-transfer guide plate for guiding a transfer sheet to be conveyed to the transfer zone is disposed on the photoconductor support means, and when a pressing force by a transfer sheet is exerted at least during the guidance of the transfer sheet, the rear surface of the pre-transfer guide plate is brought into contact with a development housing constituting the developing unit.

DETAILED DESCRIPTION OF THE PREFERRED EMBODIMENTS

An embodiment of a process unit of an image forming machine constructed in accordance with the present invention will be described in detail with reference to the accompanying drawings. In the illustrated embodiment, a printer will be taken as an example of the image forming machine equipped with the process unit constructed in accordance with the invention.

Figure 1:
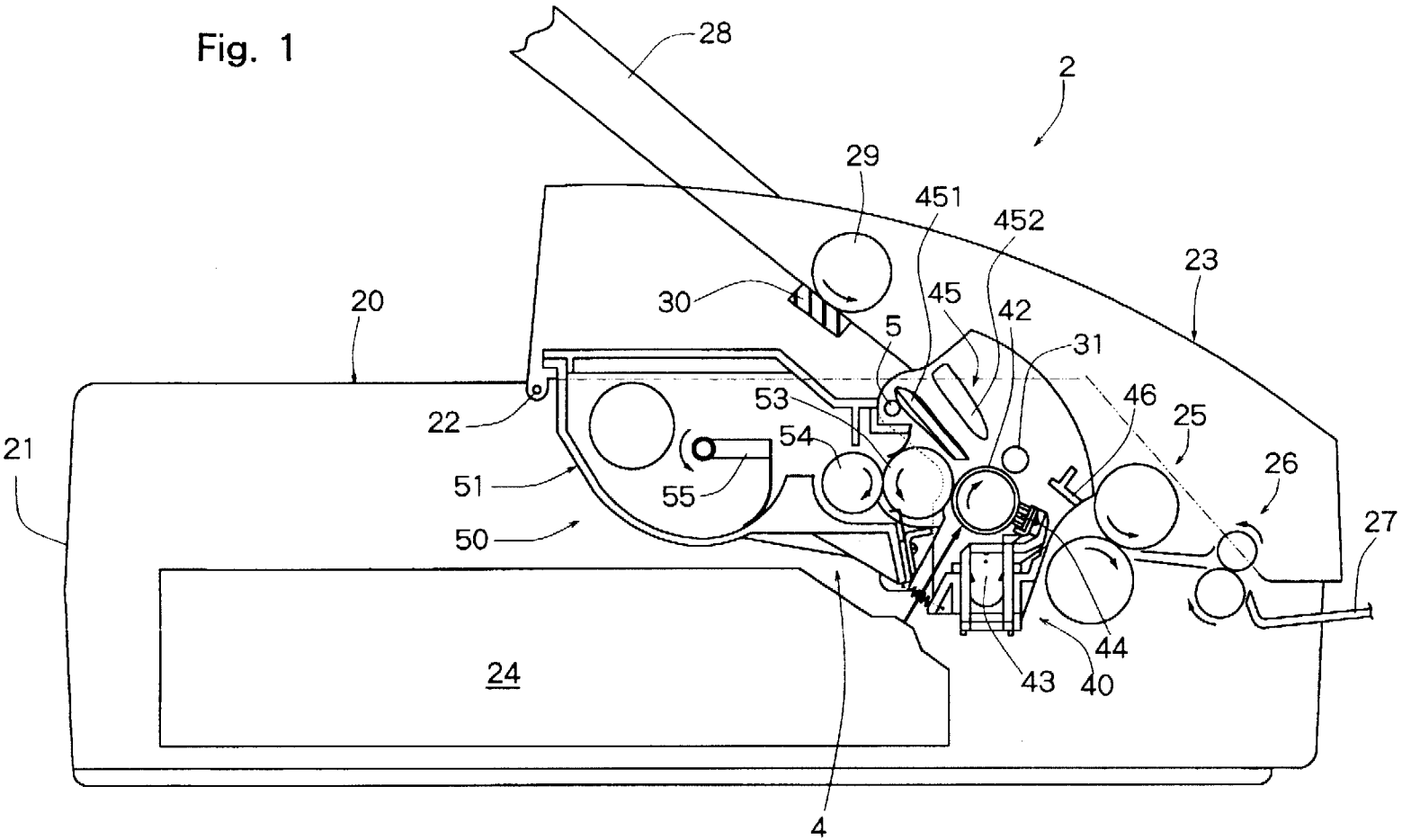
FIG. 1 is a front view schematically showing a printer having an embodiment of a process unit constructed in accordance with the present invention.

FIG. 1 schematically shows a printer 2 on which an embodiment of the process unit constructed in accordance with the invention is mounted. In this embodiment, the printer 2 is a compact, slow-speed laser printer for use as a printer for a word processor, and has a machine housing 20 molded from a plastic material. This machine housing 20 includes an upwardly open box-shaped housing body 21, and a cover 23 mounted turnably on a shaft 22 disposed at the top of the housing body 21. At nearly the center of the machine housing 20 so constructed, a process unit 4 is mounted detachably.

Figure 2:
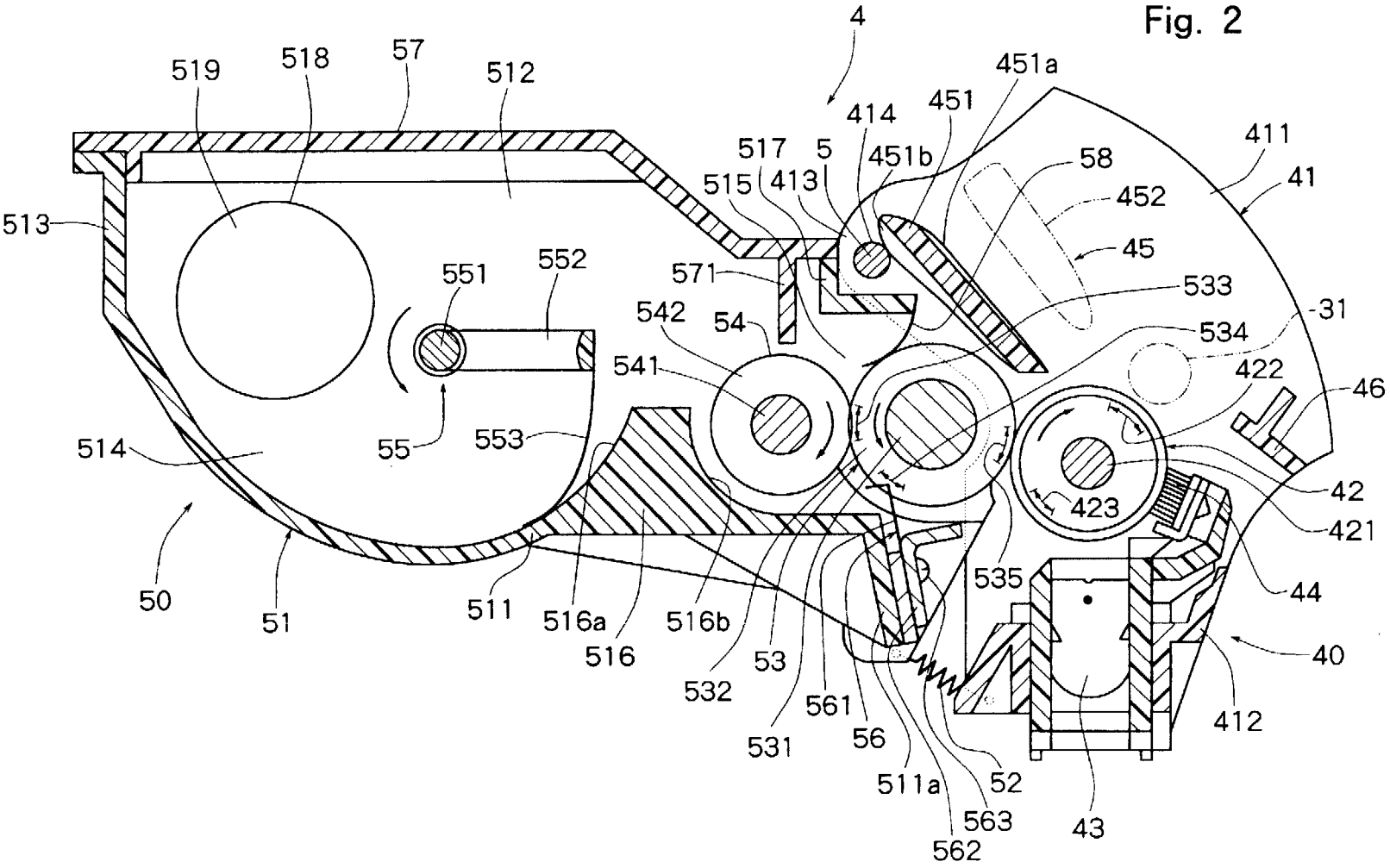
FIG. 2 is a sectional view of the process unit of FIG. 1 that is constructed in accordance with the present invention.

The process unit 4, as shown in FIG. 2, has a photoconductor unit 40, and a developing unit 50 pivotably supported at an upper part of the photoconductor unit 40 via a support shaft 5. The photoconductor unit 40 has a photoconductor support means 41. The photoconductor support means 41 has a pair of side wall members 411 arranged with spacing in the back-and-forth direction (the direction perpendicular to the sheet face of FIG. 2) (only the rear side wall member is shown in FIG. 2), and a connecting member 412 which connects together lower parts of the pair of side wall members 411. The so constructed photoconductor support means 41 is integrally molded from a plastic material. At the upper end parts, on the developing unit 50 side, of the pair of side wall members 411 constituting the photoconductor support means 41, support portions 413 having mounting holes 414 are provided. By inserting the support shaft 5 made of a metal bar material, which is disposed in a development housing (to be described later on) of the developing unit 50, into the mounting holes 414 provided in the support portions 413, the photoconductor unit 40 and the developing unit 50 are supported so as to be pivotable relative to each other.

The photoconductor unit 40 has a photoconductor drum 42 having a photosensitive layer on its peripheral surface. The photoconductor drum 42 has its rotating shaft 421 rotatably supported by the pair of side wall members 411 constituting the photoconductor support means 41, and rotationally driven by a drive means (not shown) in the direction of an arrow, i.e., from below to above in a developing zone, the site of contact (the site of nip) with a developing roller (to be described later on) of the developing unit 50. On the connecting member 412 of the photoconductor support means 41, a charging corona discharger 43 is disposed opposite the lower peripheral surface of the photoconductor drum 42. Upstream from the charging corona discharger 43 in the direction of rotation of the photoconductor drum 42, a paper dust removing brush 44 is disposed in contact with the peripheral surface of the photoconductor drum 42.

Between the pair of side wall members 411 constituting the photoconductor support means 41, there is disposed a lower guide plate 451 constituting one of a pair of pre-transfer guide plates 45 for guiding a transfer sheet, which is fed from upper left in FIG. 2, in a place above the photoconductor drum 42 toward a transfer zone 422 on the peripheral surface of the photoconductor drum 42. This lower guide plate 451 is molded integrally with the pair of side wall members 411. On the top surface of the lower guide plate 451, a plurality of guide ribs **451*a* are integrally molded with spacing in the longitudinal direction (the direction perpendicular to the sheet face of FIG. 2). On the bottom (rear) surface of the lower guide plate 451, too, a plurality of reinforcing ribs 451*b* are integrally molded with spacing in the longitudinal direction (the direction perpendicular to the sheet face of FIG. 2). These reinforcing ribs 451*b* are adapted to contact the support shaft 5. Thus, the lower guide plate 451 can be prevented from deflecting because of the contact of the reinforcing ribs 451*b* with the support shaft 5, even when a pressing force acts on the top surface of the lower guide plate 451 in an attempt to cause its deflection. The reinforcing ribs 451*b* and the support shaft 5 may be in contact with each other when the process unit is assembled. However, their positions of contact are difficult to align by strict dimensional control, because of possible errors in production and assembly. Hence, there may be a design in which a tiny gap is provided between the reinforcing ribs 451*b* and the support shaft 5, and when a pressing force of a transfer sheet being guided acts on the lower guide plate 451 to deflect it slightly, the reinforcing ribs 451*b* make contact with the support shaft 5. Furthermore, the lower guide plate 451 is molded integrally with the pair of side wall members 411 provided with the mounting holes 414 through which the support shaft 5 is inserted. Thus, the lower guide plate 451 has no variations from product to product, and any product can ensure the contact relationship between the lower guide plate 451 and the support shaft 5. The lower guide plate 451 can function as a connecting member for connecting together the upper parts of the pair of side wall members 411 constituting the photoconductor support means 41, thereby improving the rigidity and strength of the photoconductor support means 41. In the illustrated embodiment, moreover, the lower guide plate 451 is molded integrally with the pair of side wall members 411, so that it can maintain a highly precise positional relationship with the photoconductor drum 42 supported rotatably on the pair of side wall members 411. In addition, the lower guide plate 451 in the illustrated embodiment can function not only as a member for preventing contact with the photosensitive layer of the photoconductor drum 42 at the time of mounting or dismounting the process unit 4, but also as a member for preventing a touch on the developing roller (to be described later on) of the developing unit 50**.

Another embodiment of the lower guide plate 451 constituting the pre-transfer guide plate pair 45 will be described with reference to FIG. 3.

Figure 3:
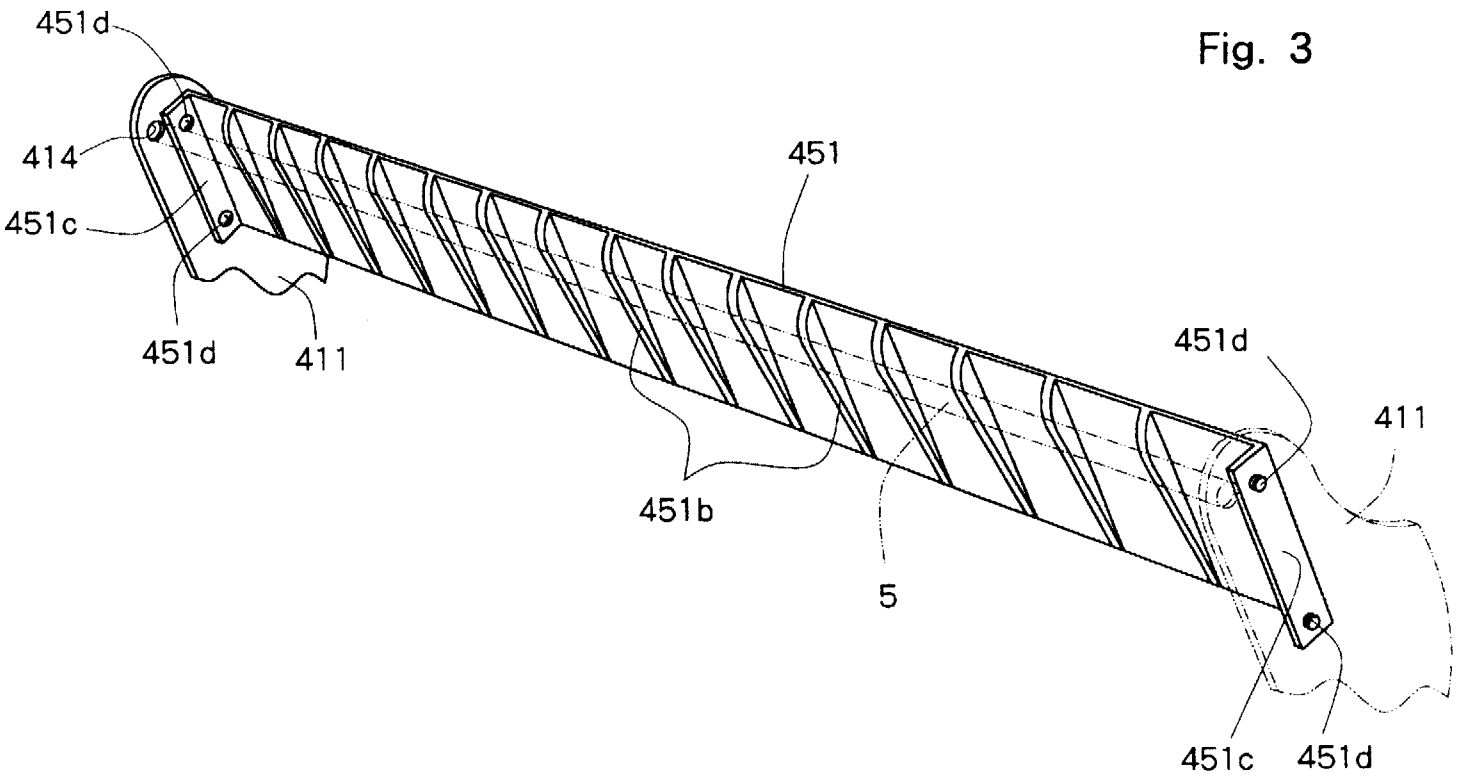
FIG. 3 shows another embodiment of a pre-transfer guide plate disposed in a photoconductor unit constituting the process unit illustrated in FIG. 2, as a perspective view of the pre-transfer guide plate viewed from its rear surface.

The lower guide plate 451 in the embodiment of FIG. 2 is molded integrally with the pair of side wall members 411, while a lower guide plate 451 in an embodiment illustrated in FIG. 3 is constructed from a separate member. That is, the lower guide plate 451 has mounting flanges **451*c* at its opposite ends, and these flanges 451*c* are mounted on the pair of side wall members 411 by means of machine screws 451*d***.

Between the pair of side wall members 411 constituting the photoconductor support means 41, a post-transfer guide plate 46 is disposed for guiding the transfer sheet, undergoing transfer in the transfer zone 422, to a fixing means to be described later on. The post-transfer guide plate 46 is molded integrally with the pair of side wall members 411. Thus, the post-transfer guide plate 46 can function as a connecting member for connecting together the pair of side wall members 411 constituting the photoconductor support means 41, thereby improving the rigidity and strength of the photoconductor support means 41. In addition, the post-transfer guide plate 46 in the illustrated embodiment can also function as a member for preventing contact with the photosensitive layer of the photoconductor drum 42 at the time of mounting or dismounting the process unit 4.

Next, the developing unit 50 as a latent electrostatic image developing device will be described. The developing unit 50 in the illustrated embodiment has a development housing 51 accommodating a developer comprising a one-component toner. The development housing 51 is composed of a bottom wall 511, a front side wall 512 and a rear side wall 512 (only the rear side wall is shown in FIG. 2) erected upright from the front and rear ends of the bottom wall 511 (the ends in the direction perpendicular to the sheet face of FIG. 2), and a left side wall 513. These walls are integrally molded from a plastic material, defining an agitation chamber 514 and a development chamber 515. On the bottom wall 511 constituting the development housing 51, a partition wall 516 provided in the back-and-forth direction (the direction perpendicular to the sheet face in FIG. 2) is integrally molded between the agitation chamber 514 and the development chamber 515. The left and right surfaces of the partition wall 516 are formed as arcuate guide surfaces **516*a* and 516*b*. Between the front and rear side walls 512 constituting the development housing 51, a connecting member 517 disposed in an upper part on the development chamber 515 side is provided integrally with the front and rear side walls 512. In the rear side wall 512 constituting the development housing 51, a toner supply hole 518 is formed. The toner supply hole 518 is fitted with a cap 519. In an upper end part, on the development chamber 515 side, of the so constructed development housing 51, the support shaft 5 is disposed so as to pass through the front and rear side walls 512. By fitting both end parts of the support shaft 5 into the mounting holes 414 provided in the support portions 413 of the pair of side wall members 411 constituting the photoconductor support means 41 of the photoconductor unit 40, the photoconductor unit 40 and the developing unit 50 are supported so as to be pivotable relative to each other. Between a front end site of a lower end part of the photoconductor support means 41 of the photoconductor unit 40 and a rear end site of a lower end part of the development housing 51, coiled springs 52 are interposed as spring means. These coiled springs 52 urge the photoconductor support means 41 and the development housing 51 toward each other about the support shaft 5. The development housing 51 is open upwards and rightwards, i.e., on the photoconductor unit 40** side.

Inside the development housing 51, a developing roller 53, a makeup roller 54, an agitating means 55 and a developer regulating means 56 are disposed.

The developing roller 53 is disposed in the development chamber 515 of the development housing 51, and includes a rotating shaft 531 mounted rotatably on the front and rear side walls 512 constituting the development housing 51, and a solid synthetic rubber roller 532 secured to the outer peripheral surface of the rotating shaft 531. The rotating shaft 531 may be formed of a suitable metallic material such as stainless steel. The solid synthetic rubber roller 532 is composed of a relatively flexible and conductive material, e.g., conductive solid synthetic rubber such as urethane rubber. In the illustrated embodiment, the surface roughness of the peripheral surface of the solid synthetic rubber roller 532, i.e., the 10-point average roughness Rz defined in JIS B 0601, is set at 5.0 to 12.0. The volume resistivity of the solid synthetic rubber roller 532 is set at about $10^4$ to $10^9$ Ω·cm. The roller hardness of the solid synthetic rubber roller 532 is set at an Asker hardness of 60 to 80 in the illustrated embodiment. The so constructed roller 532 of the developing roller 53 is exposed through the right-hand opening formed in the development housing 51, and positioned opposite the photoconductor drum 42. The peripheral surface of the roller 532 constituting the developing roller 53 is pressed against the peripheral surface of the photoconductor drum 42 in the developing zone. At the nip in this pressed condition, the peripheral surface of the roller 532 is compressed slightly elastically. The rotating shaft 531 of the developing roller 53 is rotationally driven by a drive means (not shown) in the direction of an arrow, i.e., from below to above in the developing zone, the site of contact between the roller 532 and the photoconductor drum 42. In accordance with this rotation of the rotating shaft 531, the roller 532 is also rotationally driven in the direction of the arrow, so that the peripheral surface of the roller 532 is sequentially moved through a developer holding zone 533, a developer regulating zone 534, and a developing zone 535. In the illustrated embodiment, a constant voltage of 300V is applied to the rotating shaft 531 of the developing roller 53.

The makeup roller 54 is disposed parallel to the developing roller 53 inside the development chamber 515 of the development housing 51. The makeup roller 54 includes a rotating shaft 541 mounted rotatably on the front and rear side walls 512 constituting the development housing 51, and a roller 542 secured to the outer peripheral surface of the rotating shaft 541. The rotating shaft 541, like the rotating shaft 531 of the developing roller 53, may be formed of a suitable metallic material, such as stainless steel. The roller 542 is composed of a foam such as silicone foam or urethane foam. The roller 542 is pressed against the roller 532 of the developing roller 53 in the developer holding zone 533, the nip between the roller 542 and the developing roller 53. The hardness of the foam constituting the roller 542 of the makeup roller 54 is much smaller than the hardness of the roller 532 constituting the developing roller 53 (for example, an Asker hardness of about 35), and it is desirable that by being pressed against the roller 532 of the developing roller 53, the roller 542 be elastically compressed in the nip region by about 0.1 to 0.6 mm. The roller 542 also has conductivity, and its volume resistivity is set at about $10^2$ to $10^6$ Ω·m. The rotating shaft 541 of the developing roller 54 is rotationally driven by a drive means (not shown) in the direction of an arrow, i.e., from above to below in the developer holding zone 533, the nip between the roller 542 and the roller 532 of the developing roller 53. In accordance with this rotation of the rotating shaft 541, the roller 542 is also rotationally driven in the direction of the arrow. In the illustrated embodiment, a constant voltage of 450V, a higher voltage than the voltage applied to the developing roller 53, is applied to the rotating shaft 541 of the makeup roller 54.

The peripheral speed V1 of the photoconductor drum 42, the peripheral speed V2 of the developing roller 53, and the peripheral speed V3 of the makeup roller 54 are set in the relationship $V1<V2<V3$. In the illustrated embodiment, the relation between the peripheral speed V1 of the photoconductor drum 42 and the peripheral speed V2 of the developing roller 53 is set to be $1.2V1 \leqq V2 \leqq 2.5V1$, while the relation between the peripheral speed V2 of the developing roller 53 and the peripheral speed V3 of the makeup roller 54 is set to be $1.0V2 \leqq V3 \leqq 2.0V2$. If the peripheral speed V2 of the developing roller 53 is less than 1.2V1, the supply of a developer to the photoconductor drum 42 will be insufficient, and the density of an image may lower. If the peripheral speed V2 of the developing roller 53 is less than 1.2V1, moreover, there will be a decline in the scraping action of the developing roller 53 on the non-transferred developer that adheres to the photoconductor drum 42 after transfer. Thus, the non-transferred developer cannot be removed from the photoconductor drum 42, potentially causing a so-called offset fog. If the peripheral speed V2 of the developing roller 53 is more than 2.5V1, on the other hand, the drive torque of the developing roller 53 will increase, possibly causing a scatter of the developer by a centrifugal force. Besides, if the peripheral speed V3 of the makeup roller 54 is less than 1.0V2, the supply of a developer to the developing roller 53 will be insufficient, and image density may lower. If the peripheral speed V3 of the makeup roller 54 is less than 1.0V2, moreover, there will be a weak scraping action of the makeup roller 54 on the peripheral surface of the developing roller 53. In case the non-transferred developer adhering to the photoconductor drum 42 after transfer adheres to the developing roller 53, therefore, this adherent developer will be difficult to remove. The adherent developer may generate a ghost in a subsequent development. If the peripheral speed V3 of the makeup roller 54 is more than 2.0V2, on the other hand, the drive torque of the makeup roller 54 will increase. Simultaneously, the developer will strongly tend to rest above the nip between the makeup roller 54 and the developing roller 53, possibly causing an insufficient supply of the developer to the developing roller 53.

In the agitation chamber 514 of the development housing 51, an agitating means 55 is disposed. The agitating means 55 is disposed parallel to the makeup roller 54, and includes a rotating shaft 551 mounted rotatably on the front and rear side walls 512 constituting the development housing 51, an agitating member 552 fixed to the rotating shaft 551, and an elastic agitating sheet member 553 mounted to the agitating member 552. The agitating member 552 is formed of a plastic material, and has a plurality of openings in the longitudinal direction (the direction perpendicular to the sheet face of FIG. 2). The agitating sheet member 553 is formed of a flexible, elastic material, such as polyethylene terephthalate (PETP), and is secured by an adhesive or the like to the front edge of the agitating member 552. The so constructed agitating means 55 is rotationally driven continuously by a drive means (not shown) in the direction of an arrow in FIG. 2.

The developer regulating means 56 has a flexible, elastic blade 561 to be pressed against the peripheral surface of the roller 532 constituting the developing roller 53. The blade 561 is composed of, say, a stainless steel plate or a spring steel plate about 0.1 to 0.2 mm thick, and has nearly the same longitudinal dimension as the length of the roller 532 constituting the developing roller 53. The blade 561 has a base end part mounted on a blade mounting portion 511*a* provided at the open end, on the photoconductor unit 40 side, of the bottom wall 511 constituting the development housing 51. That is, the base end part of the blade 561 is sandwiched between the blade mounting portion 511*a* and a press plate 562, and is fixed thereto by means of a machine screw 563. A front end part of the blade 561 is bent, and this bend is pressed against the peripheral surface of the roller 532 constituting the developing roller 53 in the developer regulating zone 534.

On the development housing 51, a closure 57 is mounted which covers the open top of the development housing 51 and constitutes part of the development housing 51. The closure 57 is composed of a plastic material, and is secured by an adhesive to the top surfaces of the front and rear side walls 512, the left side wall 513 and the connecting member 517 that constitute the development housing 51. On the inner surface of the closure 57, a regulating portion 571 is integrally molded which extends in the back-and-forth direction (the direction perpendicular to the sheet face of FIG. 2) at a position opposite the makeup roller 54, and which protrudes on the development chamber 515 side. Between the lower end of the regulating portion 571 and the outer peripheral surface of the roller 542 constituting the makeup roller 54, a predetermined spacing is provided. In the illustrated embodiment, the connecting member 517 constituting the development housing 51 is mounted with a sheet-like seal member 58. The sheet-like seal member 58 is composed of a flexible, elastic sheet member of, say, polyethylene terephthalate (PETP), and has nearly the same length as the axial length of the roller 532 constituting the developing roller 53. The sheet-like seal member 58 has one end part secured to the connecting member 517 by a securing means such as an adhesive, and has the other end part curved and elastically contacted with the peripheral surface of the roller 532 constituting the developing roller 53. The so constructed sheet-like seal member 58 prevents a scatter of the developer from the opening, on the photoconductor unit 40 side, of the development housing 51 in cooperation with the blade 561 of the developer regulating means 56.

The so constructed process unit 4 is mounted detachably on the machine housing 20 of the printer 2, as shown in FIG. 1. That is, the cover 23 constituting the machine housing 20 of the printer 2 is turned about the shaft 22 counterclockwise in FIG. 1, whereby the top of the housing body 21 constituting the machine housing 20 is opened. Then, the process unit 4 is mounted inside the housing body 21 from above. Inside the housing body 21, a positioning means (not shown) capable of placing the photoconductor unit 40 of the process unit 4 at a predetermined position is provided. After the process unit 4 is mounted inside the housing body 21 of the machine housing 20, the cover 22 is turned about the shaft 22 clockwise in FIG. 1 to close the top of the housing body 21.

As shown in FIG. 1, a laser unit 24 is disposed in a lower part of the housing body 21 constituting the machine housing 20 of the printer 2. This laser unit 24 throws laser light, corresponding to print data from, say, a word processor connected to the printer 2, upon the photosensitive layer of the photoconductor drum 42 in an exposure zone 423 of the process unit 4, thereby forming a latent electrostatic image. In the housing body 21 constituting the machine housing 20 of the printer 2, a fixing roller pair 25 is disposed downstream from the post-transfer guide plate 46. Downstream from the fixing roller pair 25, a discharge roller pair 26 is disposed. Furthermore, a copy receiving or discharge tray 27 is disposed downstream from the discharge roller pair 26.

On the cover 23 constituting the machine housing 20 of the printer 2, a feed tray 28 for bearing a transfer sheet is disposed at an upper left part in FIG. 2. Downstream from the feed tray 28, a feed roller 29 is disposed. This feed roller 29 is rotationally driven by a drive means (not shown) in the direction of an arrow in FIG. 2. Opposite the feed roller 29, a friction pad 30 for sheet separation is disposed. In the transfer zone 422, a non-contact transfer roller 31 is disposed opposite the photoconductor drum 42. The transfer roller 31 is formed of a conductive urethane foam, and rotatably supported on the cover 23. The transfer roller 31 has opposite end parts mounted with collars (not shown) which are composed of an insulating material, such as synthetic resin, and each of which has a larger outside diameter than the diameter of the transfer roller 31. These collars are disposed in contact with the peripheral surface of the photoconductor drum 42. Thus, the transfer roller 31 is caused to follow the rotation of the photoconductor drum 42 while slipping. The clearance between the peripheral surface of the transfer roller 31 and the peripheral surface of the photoconductor drum 42 is set at about 0.5 mm. A constant voltage of, say, 10 μA is applied to the so constructed transfer roller 31. On the cover 23, an upper guide plate 452 constituting the other component of the pre-transfer guide plate pair 45 is disposed.

The printer 2 in the illustrated embodiment is constructed as described above. Its actions will be described with reference to FIG. 4 as well.

Figure 4:
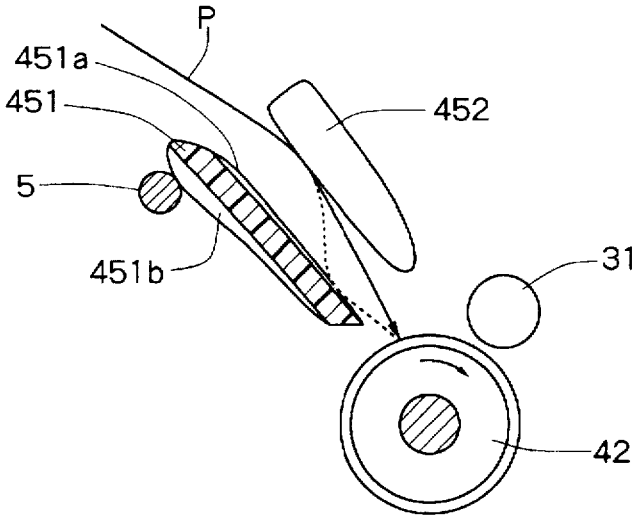
FIG. 4 is an explanatory drawing showing the movement of a transfer sheet conveyed to a transfer zone in the process unit illustrated in FIG. 2.

Based on a print command from a word processor or the like (not shown), the above-described members start operation, and the photosensitive layer on the surface of the photoconductor drum 42 is charged substantially uniformly to a specific polarity by the charging corona discharger 43. Then, the laser unit 24 throws laser light, corresponding to the print data from the word processor or the like, upon the surface of the charged photosensitive layer of the photoconductor drum 42, thereby forming a latent electrostatic image there. The latent electrostatic image formed on the photosensitive layer of the photoconductor drum 42 is developed to a toner image by the developing action of the developing unit 50. The developing action of the developing unit 50 will be described in detail later on. Transfer sheets laid on the feed tray 28 are fed one by one by the action of the feed roller 29 and the friction pad 30. The fed transfer sheet is guided by the pre-transfer guide plate pair 45, and conveyed to the transfer zone 422 where the photoconductor drum 42 and the transfer roller 31 are opposite to each other. Thus, the toner image formed on the photoconductor drum 42 is transferred to the surface of the transfer sheet. FIG. 4 shows a state immediately after the front end of the transfer sheet P, fed by the feed roller 29, contacts the photoconductor drum 42. In detail, the transfer sheet P fed by the feed roller 29 has its front end guided by the upper guide plate 452 of the pre-transfer guide plate pair 45, and brought into contact with the photoconductor drum 42. At this time, as indicated by a broken line in FIG. 4, its front end part is curved toward the lower guide plate 451, and this curvature presses the lower guide plate 451. The transfer sheet P with a strong nerve, such as a postcard, exerts a great pressing force when curved. This pressing action tends to deflect the lower guide plate 451, but the reinforcing ribs **451*b* provided on the rear surface of the lower guide plate 451 contact the support shaft 5, preventing the deflection of the lower guide plate 451. This in turn prevents defective conveyance of the transfer sheet P to the transfer zone 422** due to the deflection of the pre-transfer guide plate.

The transfer sheet, conveyed to the transfer zone 422 and having the toner image transferred thereto, is guided by the post-transfer guide plate 46 to be carried to the fixing roller pair 25. The transfer sheet having the toner image heat-fixed by the fixing roller pair 25 is discharged onto the discharge tray 27 by the discharge roller pair 26. In the illustrated embodiment, the lower guide plate 451, one of the constituents of the pre-transfer guide plate pair 45 for guiding the transfer sheet toward the transfer zone 422 on the peripheral surface of the photoconductor drum 42, is molded integrally with the pair of side wall members 411 that support the photoconductor drum 42 rotatably. Thus, the lower guide plate 451 can maintain a highly precise positional relationship with the photoconductor drum 42. Consequently, the lower guide plate 451 has no variations from product to product, and any product would permit a transfer sheet to be conveyed reliably to a predetermined position in the transfer zone 422.

The developing action of the developing unit 50 will be described.

After the start of operation of the developing unit 50, the developing roller 53, makeup roller 54 and agitating means 55 are rotationally driven by drive means (not shown) in the directions of the arrows. In accordance with the rotation of the agitating member 552 and agitating sheet member 553, constituting the agitating means 55, in the direction of the arrow, the developer accommodated in the agitation chamber 514 is passed over the partition wall 516 while being agitated, whereafter the developer is fed into the development chamber 515 from above the makeup roller 54. On this occasion, the amount of the developer fed into the development chamber 515 is controlled by the regulating portion 571 formed on the inner surface of the closure 57 so that this amount will not be excessive. The developer so supplied by the agitating means 55 is borne on the roller 542 of the makeup roller 54, and carried to the nip between the roller 542 and the roller 532 of the developing roller 53, which is also the developer holding zone 533. The makeup roller 54 and the developing roller 53, as described above, rotate in the developer holding zone 533, the nip, in the same direction, from above to below. Thus, the supply of the developer from the makeup roller 54 to the developing roller 53 is adequate, preventing lack of the developer. Since the makeup roller 54 and the developing roller 53, as described above, rotate in the same direction in the developer holding zone 533, the nip, moreover, they can be driven reliably without requiring a great drive force.

The developer sent to the developer holding zone 533, the nip between the makeup roller 54 and the developing roller 53, is conveyed toward the developer regulating zone 534 while being held on the peripheral surface of the roller 532 constituting the developing roller 53. At this time, the makeup roller 54 and the developing roller 53 rotate in the same direction, from above to below, in the developer holding zone 533, the nip, as described earlier. The developer also passes through the nip, remains held on the developing roller 53, and moves to the developer regulating zone 534 and the developing zone 535. When passing through the nip, the developer is fully rubbed against the makeup roller 54 and the developing roller 53 and fully charged, thus preventing the occurrence of a fog.

In the developer regulating zone 534, the blade 561 of the developer regulating means 56 acts on the developer held on the peripheral surface of the roller 532 of the developing roller 53 to restrict the developer held on the peripheral surface of the roller 532 to a required amount and form it into a thin layer. The developer, which has been regulated by the blade 561 of the developer regulating means 56 in the developer regulating zone 534 and scraped off onto the bottom wall 511 of the development housing 51, does not remain stationary, but is conveyed along the guide surface **516*b* of the partition wall 516, because the makeup roller 54** is rotated in the direction of the arrow.

As described above, the developer is held on the peripheral surface of the roller 532 constituting the developing roller 53 in the developer holding zone 533, and formed into a thin layer by the action of the blade 561 of the developer regulating means 56 in the developer regulating zone 534. Then, this developer is conveyed to the developing zone 535 in accordance with the rotation in the direction of the arrow.

In the developing zone 535, the developer is applied to the latent electrostatic image on the electrostatic photoconductor disposed on the peripheral surface of the photoconductor drum 42, whereby the latent electrostatic image is developed to a toner image. For example, the latent electrostatic image has a non-image area charged to about +600V, and an image area charged to about +120V, and a toner as the developer is caused to adhere to the image area (reversal development). The photoconductor drum 42 and the developing roller 53 are rotationally driven in the directions of the arrows in FIG. 2. In the developing zone 535, therefore, the peripheral surface of the photoconductor drum 42 and the peripheral surface of the roller 532 constituting the developing roller 53 are both moved in the same direction, from below to above. Since the peripheral speed V2 of the roller 532 and the peripheral speed V1 of the photoconductor drum 42 are set in the relationship 1.2V1(V2(2.5V1, a sufficient amount of the developer is carried to the developing zone 535 by the roller 532 of the developing roller 53. Also, the rubbing action of the peripheral surface of the roller 532 on the peripheral surface of the photoconductor drum 42 properly peels off the developer that has once adhered to the non-image area of the latent electrostatic image. Hence, a satisfactory image having an appropriate development density and free from fog can be obtained. The developer after use that has passed through the developing zone 535 while being held on the peripheral surface of the roller 532 constituting the developing roller 53, on the other hand, is passed on to the surface of the makeup roller 54 at the nip between the developing roller 53 and the makeup roller 54. The peripheral speed of the makeup roller 54 is set to be greater than the peripheral speed of the developing roller 53. Therefore, as the developer is shifted to the makeup roller 54 at the nip, the non-transferred developer adhering to the developing roller 53 during passage through the developing zone 535 cab be decreased in adherence, and recovered. Hence, a ghost ascribed to the non-transferred developer adhering to the developing roller 53 can be prevented.

Figure 5:
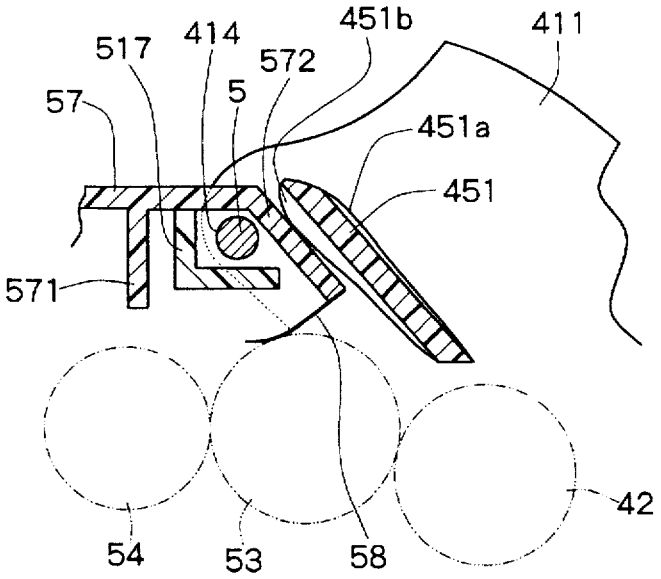
FIG. 5 is an essential part sectional view of another embodiment of a deflection preventing means of the pre-transfer guide plate disposed in the photoconductor unit constituting the process unit.

FIG. 5 shows another embodiment of the deflection preventing means for the lower guide plate 451 constituting the pre-transfer guide plate pair 45. In FIG. 5, the same members as the members in the embodiment of FIG. 2 are assigned the same numerals, and a detailed explanation for them will be omitted.

In this embodiment, the closure 57 constituting part of the development housing is formed to extend to a position opposite the rear surface of the lower guide plate 451. At its front end, a support portion 572 to be contacted by the reinforcing ribs **451*b* provided on the rear surface of the lower guide plate 451 is integrally molded. Thus, the lower guide plate 451 may be deflected by the action of the pressing force due to the curvature of the transfer sheet P, as has been described previously. However, the reinforcing ribs 451*b* provided on the rear surface of the lower guide plate 451 make contact with the support portion 572, preventing the deflection of the lower guide plate 451. In the illustrated embodiment, the aforementioned sheet-like seal member 58 is mounted on the front end of the support portion 572** by means of an adhesive.

The process unit according to the present invention has been described based on the embodiments in which it is applied to a printer. However, the present invention is in no way limited to the illustrated embodiments. The invention is applicable, for instance, to an electrostatic copier, and various changes or modifications are possible without departing from the scope of the technical concept of the invention.

Since the process unit according to the present invention is constructed as described above, it exhibits the following actions and effects:

The present invention is a process unit of an image forming machine, the process unit comprising a photoconductor unit including a photoconductor drum, and a developing unit for developing a latent electrostatic image formed on the photosensitive layer of the photoconductor drum to a toner image, the photoconductor unit and the developing unit being connected by a support shaft so as to be pivotable relative to each other; in which a pre-transfer guide plate for guiding a transfer sheet to be conveyed to a transfer zone is disposed on a photoconductor support means for supporting the photoconductor drum rotatably, and when a pressing force by a transfer sheet is exerted at least during the guidance of the transfer sheet, the rear surface of the pre-transfer guide plate is brought into contact with the support shaft. Thus, the pre-transfer guide plate may be deflected under the pressing action due to the curvature of the transfer sheet during its conveyance to the transfer zone; however, the rear surface of the pre-transfer guide plate contacts the support shaft, preventing its deflection. This in turn prevents defective conveyance of a transfer sheet to the transfer zone due to the deflection of the pre-transfer guide plate during transport of the transfer sheet. Furthermore, the pre-transfer guide plate contacts the support shaft, thus avoiding the situation that the pre-transfer guide plate provided in the photoconductor unit contacts the photoconductor drum or the developing unit to affect the pressing force working between the photoconductor drum and the developing unit. This makes it possible to prevent the occurrence of a defective image owing to a change in the pressing force.

The present invention is also a process unit of an image forming machine, the process unit comprising a photoconductor unit including a photoconductor drum, and a developing unit for developing a latent electrostatic image formed on the photosensitive layer of the photoconductor drum to a toner image; wherein a pre-transfer guide plate for guiding a transfer sheet to be conveyed to a transfer zone is disposed on a photoconductor support means for supporting the photoconductor drum rotatably, and when a pressing force by a transfer sheet is exerted at least during the guidance of the transfer sheet, the rear surface of the pre-transfer guide plate is brought into contact with a development housing constituting the developing unit. Thus, the pre-transfer guide plate may be deflected under the pressing action due to the curvature of the transfer sheet during its conveyance to the transfer zone; however, the rear surface of the pre-transfer guide plate contacts the development housing, preventing the deflection of the pre-transfer guide plate. This in turn prevents defective conveyance of a transfer sheet to the transfer zone due to the deflection of the pre-transfer guide plate during transport of the transfer sheet.

In addition, the pre-transfer guide plate is molded integrally with the pair of side wall members constituting the photoconductor support means. Thus, the pre-transfer guide plate serves as a connecting member which connects together the upper parts of the pair of side wall members, so that the rigidity and strength of the photoconductor support means can be increased. Furthermore, the pre-transfer guide plate is molded integrally with the pair of side wall members having the mounting holes through which the support shaft is inserted. Accordingly, the pre-transfer guide plate has no variations from product to product, and any product can ensure the contact relationship between the pre-transfer guide plate and the support shaft.

What we claim is:

1. A process unit of an image forming machine, said process unit comprising a photoconductor unit including a photoconductor drum having a photosensitive layer, and a developing unit for developing a latent electrostatic image formed on the photosensitive layer of the photoconductor drum to a toner image, said photoconductor unit and said developing unit being connected by a support shaft so as to be pivotable relative to each other, and said process unit being adapted to transfer the toner image to a transfer sheet conveyed to a transfer zone of the photoconductor drum; wherein said photoconductor unit includes photoconductor support means for supporting the photoconductor drum rotatably, a pre-transfer guide plate for guiding a transfer sheet to be conveyed to the transfer zone is disposed on the photoconductor support means, and when a pressing force by a transfer sheet is exerted at least during the guidance of the transfer sheet, the rear surface of the pre-transfer guide plate is brought into contact with the support shaft.

2. A process unit of an image forming machine as claimed in claim 1, wherein a plurality of reinforcing ribs are provided on the rear surface of the pre-transfer guide plate with spacing in the longitudinal direction, and said reinforcing ribs are brought into contact with the support shaft.

3. A process unit of an image forming machine as claimed in claim 1, wherein said photoconductor support means has a pair of side wall members for rotatably supporting opposite end parts of the photoconductor drum, said pair of side wall members are provided with holes through which the support shaft is inserted, and said pre-transfer guide plate is molded integrally with said pair of side wall members.

4. A process unit of an image forming machine, said process unit comprising a photoconductor unit including a photoconductor drum having a photosensitive layer, and a developing unit for developing a latent electrostatic image formed on the photosensitive layer of the photoconductor drum to a toner image, and said process unit being adapted to transfer the toner image to a transfer sheet conveyed to a transfer zone of the photoconductor drum; wherein said photoconductor unit includes photoconductor support means for supporting the photoconductor drum rotatably, a pre-transfer guide plate for guiding a transfer sheet to be conveyed to the transfer zone is disposed on the photoconductor support means, and when a pressing force by a transfer sheet is exerted at least during the guidance of the transfer sheet, the rear surface of said pre-transfer guide plate is brought into contact with a development housing constituting said developing unit.

5. A process unit of an image forming machine as claimed in claim 1, wherein a plurality of reinforcing ribs are provided on the rear surface of the pre-transfer guide plate with spacing in the longitudinal direction, and said reinforcing ribs are brought into contact with the development housing.

* * * * *